United States Patent [19]

De Nora et al.

[11] 4,072,586

[45] Feb. 7, 1978

[54] MANGANESE DIOXIDE ELECTRODES

[75] Inventors: Oronzio De Nora; Antonio Nidola; Placido M. Spaziante, all of Milan, Italy

[73] Assignee: Diamond Shamrock Technologies S.A., Geneva, Switzerland

[21] Appl. No.: 681,280

[22] Filed: Apr. 28, 1976

[30] Foreign Application Priority Data

Dec. 17, 1975 Italy ..... 30142/75

[51] Int. Cl.[2] ..... C25C 7/02; C25C 1/08; C25C 1/12; C25C 1/16

[52] U.S. Cl. ..... 204/105 M; 204/108; 204/112; 204/114; 204/119; 204/120; 204/290 R; 204/290 F; 204/291

[58] Field of Search ..... 204/290 R, 290 F, 291, 204/107, 109, 112, 114, 115, 119, 120

[56] References Cited

U.S. PATENT DOCUMENTS

| | | | |
|---|---|---|---|
| 3,491,014 | 1/1970 | Bianchi et al. | 204/242 |
| 3,562,008 | 2/1971 | Martinsons | 427/126 |
| 3,616,302 | 10/1971 | Osawa et al. | 204/40 |
| 3,632,498 | 1/1972 | Beer | 204/290 F |
| 3,663,280 | 5/1972 | Lee | 427/126 |
| 3,775,284 | 11/1973 | Bennett et al. | 204/290 F |
| 3,855,084 | 12/1974 | Feige | 204/38 R |
| 3,878,083 | 4/1975 | De Nora et al. | 204/290 F |
| 3,977,958 | 8/1976 | Caldwell et al. | 204/252 |

FOREIGN PATENT DOCUMENTS

| | | | |
|---|---|---|---|
| 605 | 9/1905 | United Kingdom | 204/291 |

*Primary Examiner*—F.C. Edmundson
*Attorney, Agent, or Firm*—Hammond & Littell

[57] ABSTRACT

Novel electrodes consisting essentially of a valve metal base or other electrically conductive material which is corrosion-resistant to the anodic conditions having on at least a portion of its outer surface an electrocatalytic coating of $\beta$-manganese dioxide chemi-deposited by thermal decomposition of an alcoholic solution of manganese nitrate which are useful in electrolysis processes in which oxygen is formed at the anode such as electrowinning of metals from sulfuric acid solution or in the electrolytic production of perchlorates. Also included are electrodes where the $\beta$-manganese dioxide coating is activated by doping with up to 5% by weight of at least one metal of the groups IB, IIB, IVA, VA, VB, VIB, VIIB, and VIII of the Periodic Table excluding the platinum group metals, gold and silver or activated by irradiation of the $\beta$-manganese dioxide coating and/or stabilized by the addition of up to 20% by weight of silicon dioxide, tin dioxide or $\beta$-lead dioxide as a mechanical stabilizer for the coating.

12 Claims, No Drawings

MANGANESE DIOXIDE ELECTRODES

STATE OF THE ART

Anodes made of manganese oxides have been known for a long time such as are disclosed in U.S. Pat. Nos. 1,296,188 and 1,143,828 and were used in the electrowinning of metals such as zinc, copper and nickel. These, however, are not suitable for commercial use for various reasons, such as the difficulties in forming said anodes. Another proposed electrode is described in U.S. Pat. No. 3,855,084 wherein titanium particles are cemented with thermally deposited manganese dioxide and a second outer coating of electrodeposited manganese dioxide is deposited thereon.

More recently, dimensionally stable anodes made of a valve metal base such as titanium and provided with an outer coating of at least one platinum group metal oxide have been proposed in U.S. Pat. Nos. 3,632,498 and 3,711,385. One of the preferred electrodes of the group for electrowinning has been found to be a valve metal base coated with a coating of tantalum oxide and iridium oxide since the anode is more stable to the oxygen evolved at the anode during electrowinning. However, these anodes are rather expensive due to the high cost of iridium and experience with the anodes has shown that the presence of manganese ions in the electrolyte adversely affects the coating by precipitation of manganese oxides on the anode and manganese is a common impurity in ores of metals to be electrowon.

Such manganese oxides, usually of the $\gamma$ type, do not show any electrocatalytic properties and are electrically insulating and therefore the anode becomes progressively disactivated. Furthermore, manganese beside being a very common impurity in the ores of metals to be electrowon may be deliberately introduced into the electrolytic solutions during their chemical purification processes of the leaching solution.

OBJECTS OF THE INVENTION

It is an object of the invention to provide novel electrodes with a coating of manganese dioxide that is catalytic to oxygen evolution.

It is another object of the invention to provide a metal anode with a coating of mechanically stable manganese dioxide.

It is a further object of the invention to provide novel anodes with a coating of manganese dioxide activated by the addition of doping metals or by means of irradiation.

It is an additional object of the invention to provide a more advantageous and economical method for the recovery of metals from electrolytic solutions by means of the use of anodes coated with manganese dioxide.

These and other objects and advantages of the invention will become obvious from the following detailed description.

THE INVENTION

The novel electrodes of the invention are comprised of a base of valve metal or of a metallic alloy having similar characteristics to those of valve metals, or a base of other electrically-conductive material which is corrosion-resistant to the anodic conditions having, on at least one part of its outer surface, an electrocatalytic coating of $\beta$-type manganese dioxide chemically deposited by means of the thermal decomposition of an alcoholic solution of manganese nitrate.

The characteristic of valve metals which is intended in the present context consists of the capacity of the metal or the metal alloy to prevent the conduction of current towards the anode forming a protective film of non-conductive oxide. Such metallic materials lend themselves to constituting the base of anodes coated on the surface by a layer of electrocatalytic and electrically-conductive materials, inasmuch as the capacity of passivation of these materials protects the base from corrosion on the surfaces exposed to the electrolyte and in particular in the pores of the electrocatalytic coating.

The valve metal base can be titanium, tantalum, zirconium, niobium, tungsten or alloys of these metals such as titanium containing up to 5% by weight of cobalt or manganese. However, other electrically-conductive materials which are corrosion-resistant to the anodic conditions may be used as a base, such as, for example, graphite, silicon-iron alloys, etc. The base is conveniently treated by sand-blasting and/or pickling before being coated with the $\beta$-type manganese dioxide coating and may or may not be provided with an intermediate coating of a valve metal oxide, or of a metal of the platinum group or with an intermediate layer comprising at least one oxide of a metal belonging to the platinum group. Such intermediate layer may have a thickness in the order of one micron and would therefore be porous.

It has been found that, of the various allotropic types of manganese dioxide, the type that shows the best electrocatalytic and electroconductive properties is the $\beta$-type. Other types, such as the $\gamma$-type, are practically without any catalytic properties and are virtually electrically insulating. Various techniques have been tried in order to form a layer of $\beta$-$MnO_2$ and it has been found that deposition by thermal means gives the desired results.

Various salts apart from nitrate salts have been tested for the thermal deposition of manganese dioxide coating on the valve metal base; i.e. organic salts such as manganese resinate and inorganic salts such as manganese carbonate and chloride, ammonium permanganate etc., but the manganese dioxide coatings formed from these salts, as illustrated later, present an initial anode potential that is too high or else become passive within a short time. An electrode used for oxygen discharge in aqueous solutions is conveniently considered passivated when the anode potential, at the working current density, rises above 2 volts from the initial value of about 1.80 volts.

The electrocatalytic activity of $\beta$-$MnO_2$ for the evolution of oxygen is thought to be related to the following factors: (a) high conductivity of the $\beta$-$MnO_2$ which is on the order of magnitude of the free metal, (b) high unstoichiometric degree of $\beta$-$MnO_2$ due to the presence of oxygen vacancies, (c) presence of traces of $Mn^{3+}$ and $Mn^{2+}$ which may act as oxygen carriers through the recurrent patterns:

$$Mn^{III}O_{1.5} + 0.50H^- \rightarrow Mn^{IV}O_2 \text{ (active form)} + 0.5H^+ + e$$

$$Mn^{IV}O_2 \text{ (active form)} \rightarrow Mn^{III}O_{1.5} + \tfrac{1}{2}(O_2)$$ and (d) high roughness factor.

It has been found that to obtain a manganese dioxide which is highly catalytic to oxygen evolution, several conditions have a significant bearing on the resulting manganese dioxide. The $Mn(NO_3)_2$ solution must not contain sulfates, chlorides or phosphates which favor the formation of other, non-conductive $MnO_2$ phases. The temperature, duration and atmosphere of the heat treatment must lie in a range which makes the conversion of the nitrate salt into manganese dioxide complete but which avoids the complete conversion of non-stoichiometric $MnO_{2-x}$ to stoichiometric $MnO_2$.

One of the preferred methods of the invention for coating, for example, a titanium base with catalytic $\beta$-$MnO_2$ comprises: Surface conditioning of the metal base by sand-blasting with steel grit followed by etching in boiling 20% HCl for 10 to 20 minutes followed by application of a thin layer of $RuO_2.TiO_2$ on the etched titanium base by thermal deposition. The liquid solution includes $RuCl_3.3H_2O$, $TiCl_3$, hydrogen peroxide and isopropyl alcohol and the solution may be applied by brush, roller or equivalent technique and after drying, the coated titanium base is heat-treated at 450°-500° C in air for 10 minutes. The precoating of $RuO_2.TiO_2$ improves the adherence between the titanium base and the $\beta$-$MnO_2$ coating because the three oxides are isomorphous. The $\beta$-$MnO_2$ is then thermally deposited on the precoated titanium base with a solution of the following composition:

10 volumes of $Mn(NO_3)_2$ 50% solution and 1 volume of isopropyl alcohol.

The solution is applied by brush in several subsequent layers. Each coat is first allowed to dry and then is thermally treated in an oven at 300° to 320° C with air circulation for about 10 minutes. The average amount of $\beta$-$MnO_2$ deposited for each layer is about 1 g/m$^2$ calculated as Mn and the procedure is repeated 20 to 40 times.

The manganese dioxide coated electrodes of the invention are excellent for the discharge of oxygen from sulfuric solutions at temperatures of up to 40° C. For example, at a temperature of about 30° C and at a current density of 600 A/m$^2$ in a 10% aqueous solution of sulfuric acid, the electrodes show an anode potential of $\leqq$1.85 volts after 150 days of operation and at 40° C and under the same working conditions, the electrodes prove to be active even after 80 days of operation.

At temperatures above 60° C, the consumption of the manganese dioxide coating becomes marked and this leads to a more rapid deactivation of the electrode. To overcome this difficulty, it has been found that the manganese dioxide coating can be made more mechanically stable even at high temperatures and moreover can be made more active by suitable modifications.

In order to stabilize the manganese dioxide coating, it has been found that up to 20% of the weight of the manganese dioxide coating, calculated as metal, can be substituted with silicon dioxide, tin dioxide and/or $\beta$-type lead dioxide. Such elements are added to the alcoholic solution of manganese nitrate in a suitable manner under the form of thermically decomposible compounds such as tin nitrate, lead nitrate and silicon alcoholates from alcohols having 1 to 7 atoms of carbon, such as methanol, ethanol, butanol etc. The results of the tests show that the stabilizers reduce the rate of consumption of the anode coating with respect to oxygen discharge.

The manganese dioxide coating of the present invention can be made more catalytically active by the addition of up to 5% by weight of a metal selected from Groups IB, IIB, IVA, VA, VB, VIB, VIIB and VIII of the Periodic Table, excluding noble metals. Examples of suitable metals are copper, zinc, cadmium, tin, lead, arsenic, vanadium, chromium, molybdenum, manganese, rhenium, iron, nickel and cobalt. Cobalt is the preferred metal as coatings doped with this metal give excellent results.

The addition of cobalt, in percentages from 0.5 to 5.0% of the weight of the coating referred to as metals, produces, for the $\beta$-type manganese dioxide coating, an electrode that proves to be electrocatalytically active after 1500 hours of operation as an anode in the electrolysis of 10% sulfuric acid solutions and at a current density of 600 A/m$^2$ at a temperature of 60° C.

The addition of a doping metal such as cobalt to the $\beta$-type manganese dioxide coating can result in the solubility of the cobalt or of its oxide in the $\beta$-$MnO_2$ lattice, increasing the number of electron holes in the structure that favor anodic reactions for which the transfer processes of the electrons form ions at the anode constitute the process which controls the dynamics of the overall anodic reaction. Other theories explaining the improvement in electrocatalytic activity due to the addition of cobalt to the coating are possible; in particular, cobalt may result in being present as a mixture of $Co^{2+}$ and $Co^{3+}$, a redox system which can favor the oxidation of the $OH^-$ ions to $H_2O_2$, favoring the evolution of oxygen, or else the cobalt might disturb the crystalline structure of $\beta$-$MnO_2$ creating structural defects that act as catalytic sites with respect to anodic reactions.

The doping metal such as cobalt may be added to the manganese nitrate solution in the form of thermically decomposible salt such as its nitrate.

Another method for increasing the electrocatalytic activity of the $\beta$-$MnO_2$ coating consists of bombarding the coating with $\beta$ rays such as those radiated from 304 plutonium for a period of time sufficient for activating the coating, which can vary from 1 to 4 hours. Radiation with $\beta$-rays could act upon the coating by modifying the electron configuration in the energy levels of the $Mn^{4+}$ and $O^{2-}$ ions. Furthermore, it has been shown by experiments carried out that electrodes subjected to this radiation present an anodic potential that is lower for oxygen discharge and a reduction in the consumption rate of the coating.

The formation of the $\beta$-$MnO_2$ coating can be effected by the application of a solution of manganese nitrate in alcohol onto the base of the electrode, and by treating the base of the electrode covered by the solution in an atmosphere containing oxygen, for example in air, at a temperature between 200° and 500° C, preferably between 250° and 350° C, for a period of time sufficient to decompose the manganese nitrate. The process is repeated until the desired thickness of the $\beta$-$MnO_2$ coating is obtained. The normal heating time for each application is between 5 and 20 minutes, 10 minutes being sufficient in most cases.

The electrodes of the invention are particularly suitable for the electrowinning of metals from sulfuric acid solutions. They can be placed between the traditional lead-based consumable anodes and the most recent dimensionally stable anodes with catalytic coatings based on noble metal oxides. In comparison with the former, they offer advantages of dimensional stability, long life and reduced cell voltages and in comparison with the latter, they offer substantially similar characteristics of voltage and life with a much lower cost electrode inasmuch as they do not contain precious metals and can be easily reconditioned by renewal of the electrocatalytic layer on the surface.

It has furthermore been found that the presence of impurities such as manganese, or cobalt ions in the electrolysis solution does not jeopardize either the catalytic activity or the life of the electrodes. It is to be assumed from this that the manganese and cobalt oxides that precipitate onto the anode have electrocatalytic and electroconductive properties, being conditioned by the presence of manganese dioxide in the allotropic $\beta$-form on the anode surface.

Therefore, the improved method for the electrowinning of metals such as copper, cobalt, nickel, tin and zinc from sulfuric acid solutions containing salts of said metals consists of the electrolysis of the solution using a cathode and, as anode, an electrode having a valve metal base, or a base of other, electrically conductive material that is corrosion-resistant to anodic conditions, coated on at least part of its surface with an electrocatalytic coating mainly composed of $\beta$-type manganese dioxide deposited by means of thermal decomposition of an alcoholic solution of manganese nitrate in the presence of oxygen.

The anodes of the present invention are also particularly suited for the electrolytic production of perchlorates. A preferred anode for the electrolytic production of perchlorate comprises an electrode with an outer layer of catalytic $\beta$-$MnO_2$ containing from 0.5 to 5.0% by weight of at least one metal selected from the group including As, Sb and Bi.

$\beta$-$MnO_2$ anodes have been tested for the production of perchlorate by electrolysis of an aqueous electrolyte having the following composition;

150 g/l of $NaClO_3$
450 g/l of $NaClO_4$
3 g/l of Phosphates and at 40° C and at a current density of 1200 to 1700 A/m$^2$, and remarkable faraday efficiencies ranging from 70 to 92% were recorded. The best results, namely faraday efficiencies above 90%, have been obtained with $\beta$-$MnO_2$ coatings containing up to 5% by weight of As, Sb and Bi.

The doping agents such as Ag, Sb and Bi are thought to shift the oxygen potential of the catalytic $\beta$-$MnO_2$ coating above the perchlorate formation potential. This means that the energy gap between the main anodic reaction $$ClO_3^- + H_2 \rightarrow ClO_4^- + 2H + 2e$$

and the side reaction $$H_2O \rightarrow \tfrac{1}{2}(O_2) + 2H + 2e$$

is increased, therefore increasing the perchlorate faraday efficiency.

In the following examples there are described several preferred embodiments to illustrate the invention. However, it is to be understood that the invention is not intended to be limited to the specific embodiments.

EXAMPLE 1

Titanium coupons 10 mm x 10 mm 1 mm were sandblasted and were then provided with an outer coating of manganese dioxide applied by thermal deposition of the liquid coating solutions of Table I under the conditions reported therein. The coating solution and heating was made 10 times for each sample to obtain a final coating of 1 g/m$^2$ calculated as manganese metal.

TABLE I

| Sample No. | Liquid Coating Composition | Conditions of thermal deposition in air Temp. °C | Time (min.) |
|---|---|---|---|
| 1 | Mn resinate (5% weight as metal Mn) | 250 | 10 |
| 2 | Mn resinate (5% weight as metal Mn) | 350 | 10 |
| 3 | $MnCl_2$ (10 g/l as Mn) dissolved in aqueous ethanol solution | 250 | 10 |
| 4 | $MnCl_2$ (10 g/l as Mn) dissolved in aqueous ethanol solution | 350 | 10 |
| 5 | $Mn(CO_3)_2$ (10 g/l as Mn) dissolved in Pyrrolydine and alcohol | 250 | 10 |
| 6 | $Mn(CO_3)_2$ (10 g/l as Mn) dissolved in Pyrrolydine and alcohol | 350 | 10 |
| 7 | $(NH_4)_2Mn_2O_7$ (10 g/l as Mn) dissolved in aqueous ethanol solution | 250 | 10 |
| 8 | $(NH_4)_2MN_2O_7$ (10 g/l as Mn) dissolved in aqueous ethanol solution | 350 | 10 |
| 9 | $Mn(NO_3)_2$ (50 g/l as Mn) dissolved in aqueous ethanol solution | 250 | 10 |
| 10 | $Mn(NO_3)_2$ (50 g/l as Mn) dissolved in aqueous ethanol solution | 350 | 10 |

The resulting samples were then tested in an electrolysis cell for the electrolysis of 10% sulfuric acid solution at 600 A/m$^2$ at 60° C and the anode potential was determined initially and after 100 hours of operation as well as the weight loss of the coating after 100 hours of operation. The results are reported in Table II.

TABLE II

| Sample No. | Anode Potential V(NHE) Initial | After 100 Hrs. | Coating Weight Loss mg/cm$^2$ |
|---|---|---|---|
| 1 | 3.9 | — | — |
| 2 | 3.8 | — | — |
| 3 | 1.9 | 3.0 | — |
| 4 | 1.9 | 3.0 | — |
| 5 | 2.2 | 3.0 | Negligible |
| 6 | 2.0 | 3.0 | " |
| 7 | 1.9 | 4.0 | — |
| 8 | 1.8 | 4.0 | — |
| 9 | 1.8 | 1.8 | Negligible |
| 10 | 1.7 | 1.7 | " |

The results of Table II show that only manganese dioxide obtained by thermal decomposition of manganese nitrate shows a satisfactory anode potential initially and after 100 hours of operation. The other samples either have too high an initial anode potential or become rapidly passivated in less than 100 hours of operation. The coating weight loss is also negligible after 100 hours of operation.

EXAMPLE 2

Titanium samples (10 × 10 × 1 mm) were sandblasted and were then electroplated in the baths of Table III and then the even numbered samples were heated at 300° C in air for 30 minutes. The coupons were then tested as anodes in the electrolysis of 10% sulfuric acid at 600 A/m$^2$ at 60° C and the anode potentials and coating weight loss were determined as in Example 1. The results are reported in Table III.

TABLE III

| Sample No. | Bath Composition | Anode Potential V(NHE) Initial | Anode Potential V(NHE) After 100 hrs. | Coating Weight Loss mg/cm² after 100 hrs. |
|---|---|---|---|---|
| 1 | $Mn(NO_3)_2+HNO_3$ (1 - 10%) | 2.1 | > 3 | Nil |
| 2 | " | 2.1 | > 3 | Nil |
| 3 | $Mn(SO_4)+H_2SO_4$ (1 - 10%) | 2.5 | > 4 | Nil |
| 4 | " | 2.4 | > 4 | Nil |
| 5 | $MnCl_2+NaNO_3$ (1 - 10%) | 1.8 | > 5 | Nil |
| 6 | " | 1.8 | > 5 | Nil |
| 7 | $KMnO_4+HNO_3$ (1 - 10%) | 3.0 | — | Nil |
| 8 | " | 3.5 | — | Nil |
| 9 | Mn resinate (5%) + Propylene Carbonate | 3.0 | > 3.0 | Nil |
| 10 | " | 1.9 | > 3.0 | Nil |

The results of Table III show that the electrodeposited manganese dioxide electrodes do not operate satisfactory and are passivated to begin with or in less than 100 hours of operation.

EXAMPLE 3

Ten titanium alloy coupons 10 × 10 × 1 mm were sandblasted and were then coated by brush with an ethanol solution of 50 g/l of manganese nitrate. The samples were then heated for 10 minutes at the temperature shown in Table IV and the procedure was repeated until the coupons had a coating of 1 g/m² of $MnO_2$. The coupons were then used as anodes for the electrolysis of a 10% sulfuric acid solution at 60° C and 600 A/m² and the anode potentials and coating weight loss after 100 hours were noted. The results are in Table IV.

TABLE IV

| Sample No. | Alloy | Heating in ° C | Anode Potential V(NHE) initial | Anode Potential V(NHE) 100 hr. | Coating Weight loss mg/cm² |
|---|---|---|---|---|---|
| 1 | Ti-Pd(0.2%) | 250 | 1.8 | 1.8 | Negligible |
| 2 | | 350 | 1.7 | 1.75 | " |
| 3 | Ti-Cu(2%) | 250 | 2.0 | 2.9 | " |
| 4 | | 350 | 2.0 | 2.9 | " |
| 5 | Ti-Ni(1.5%) | 250 | 2.2 | 4.0 | " |
| 6 | | 350 | 2.0 | 3.0 | " |
| 7 | Ti-Mn(1.5%) | 250 | 1.7 | 1.73 | " |
| 8 | | 350 | 1.68 | 1.70 | " |
| 9 | Ti-Co(1.5%) | 250 | 1.6 | 1.6 | " |
| 10 | | 350 | 1.5 | 1.5 | " |
| 11 | Commercially | 250 | 1.8 | 1.8 | " |
| 12 | Pure Ti | 350 | 1.7 | 1.8 | " |

The results of Table IV show that the presence of cobalt and manganese especially in the titanium base sharply improves the catalytic activity of the manganese dioxide coating for oxygen evolution as compared to the anodes with a commercially pure titanium substrate. Moreover, the catalytic activity appears to be slightly better for the anodes prepared at the higher temperature of 350° C.

EXAMPLE 4

Using the procedure for sample No. 10 of Example 1 13 titanium coupons 10 × 10 × 1 mm were sandblasted and coated with manganese dioxide and the resulting coupons were used for the electrolysis of 10% sulfuric acid at 0.6 KA/m² with the additives listed in Table V at the temperatures listed therein. The anode potential and the coating weight loss was determined as in Table V.

TABLE V

| Sample No. | Temp. ° C | Electrolyte additive as metal | Anode Potential V(NHE) initial | Anode Potential V(NHE) 50 days | Anode Potential V(NHE) 100 days | Coating Wgt. loss mg/cm² 50 days | Coating Wgt. loss mg/cm² 100 days |
|---|---|---|---|---|---|---|---|
| 1 | 25 | | 1.83 | 1.85 | 1.90 | — | 0.2 |
| 2 | 40 | | 1.75 | 1.76 | 1.99 | 0.2 | 0.6 |
| 3 | 60 | | 1.7 | 1.72 | 2.70 | 0.2 | 3.0 |
| 4 | 25 | 3g/l $MnSO_4$ | 1.83 | 1.85 | 1.89 | +0.2 | +1.6 |
| 5 | 40 | | 1.78 | 1.79 | 1.95 | +1.4 | +6.8 |
| 6 | 60 | | 1.75 | 1.75 | 3.0 | +1.2 | +6.0 |
| 7 | 25 | 3g/l of $CoSO_4$ | 1.84 | 1.84 | 1.84 | +1.5 | +6.0 |
| 8 | 40 | | 1.8 | 1.84 | 1.87 | +2.6 | +7.5 |
| 9 | 60 | | 1.7 | 1.89 | 2.9 | +2.0 | +19.0 |
| 10 | 25 | 3g/l of $MnSO_4$ + | 1.84 | 1.84 | 1.89 | +1.6 | +2.3 |
| 11 | 40 | 3g/l of $CoSO_4$ | 1.76 | 1.76 | 2.00 | +0.3 | +8.0 |
| 12 | 60 | | 1.72 | 1.2 | 3.5 | +1.0 | +8.0 |
| 13 | 40 | 3g/l of $MnSO_4$ + 40g/l of $CuSO_4$ | 1.78 | 1.79 | 1.95 | +0.5 | +3.0 |

Table V shows that the failure rate or passivative rate increases as the electrolysis temperature increases but that satisfactory results are still obtained after 100 hr. at temperatures at 40° C or less. There is a slight wear rate of the coating when there are no additives but there is an increase in the coating weight when the solution contains an additive. The presence of cobalt in the bath slightly improves the electrocatalytic activity of the manganese dioxide.

EXAMPLE 5

Titanium coupons 10 × 10 × 1 mm were sandblasted and coated with manganese dioxide as in Example 1 with a heating of the anode at 350° C until the coating was 40 g/m² of $MnO_2$. The coupons were then used as anodes for the electrolysis of a 10% sulfuric acid solution at 600 A/m² at 60° C and the results are listed in the said Table VI cobalt ions were placed in the electrolytes at the doses shown in the Table.

TABLE VI

| Sample No. | g/l of cobalt | Anode POtential V(NHE) after 500 hrs. | Wear Rate g/m² |
|---|---|---|---|
| 1 | 0.0 | failed | — |
| 2 | 0.5 | 2.05 | — |
| 3 | 1.0 | ≦ 1.75 | Nil |
| 4 | 1.5 | ≦ 1.75 | Nil |

The results of Table VI show that the presence of cobalt in the electrolyte sharply increases the coating life at higher operating temperatures as the electrodes were still active after 500 hours of operation with a cobalt addition of at least 1 g per liter. An anode potential of 2.0 or more is considered to be inactive as the economics of the process are too great at this point.

EXAMPLE 6

Titanium coupons measuring 10 × 10 × 1 cm were sandblasted and coated with β-manganese dioxide as in Example 1 for a final coating weight of 60 g/m². Coupons 1, 2 and 3 contained only manganese dioxide in the coating and coupons 4 and 5 contained 1.2 g/m² of cobalt in the coating as the doping agent. Coupon 6 was activated by β-radiation emitted by Pu $^{304}$ for 3 hours. Coupons 7, 8 and 9 contain silicon dioxide in the coating in silicon-manganese ratio of 2:4, 1:4 and 0.5:4 respectively, calculated as metal. The silicon was added to the coating solution as silicon ethylate. The coupons were then used as anodes for the electrolysis of a 10% sulfuric acid solution at 600 A/m² at varying temperatures for 2000 hours and the anode potential and wear rate were determined. The results are reported in Table VII.

TABLE VII

| Coupons | Electrolysis (° C) | Anode Potential (V(NHE)) 500 hrs. | 1000 hrs. | 2000 hrs. | Wear rate ($g/m^2$) |
|---|---|---|---|---|---|
| 1 | 25 | 1.70 | 1.72 | 1.73 | < 10 |
| 2 | 40 | 1.70 | failed | — | ≃ 55 |
| 3 | 60 | failed | — | — | ≃ 49 |
| 4 | 40 | 1.65 | 1.70 | 1.80 | < 10 |
| 5 | 60 | 1.64 | 1.75 | 1.82 | < 10 |
| 6 | 60 | 1.60 | 1.73 | 1.85 | < 5 |
| 7 | 25 | 1.80 | 1.83 | 1.85 | Nil |
| 8 | 40 | 1.70 | 1.78 | 1.81 | Nil |
| 9 | 60 | 1.70 | 1.78 | 1.84 | Nil |

The data of Table VII shows that the β-manganese dioxide coatings on titanium are excellent anodes for electrolysis at temperatures of less than 40° C but the wear rate increases at higher temperatures such as 40° C and 60° C. However, the addition of cobalt to the β-manganese dioxide coating improves the coating life. As can be seen from the Table, the cobalt-doped coatings are still active after more than 1500 hours at 40° and 60° C while the non-doped coatings of coupons 1 to 3 failed at 1000 hours at 40° C and after 500 hours at 60° C.

The addition of silicon dioxide in the coating at a percentage not greater than 20% of the coating improves the mechanical properties of the coating without increasing the oxygen over potential. Irradiated β-manganese dioxide coatings have a higher catalytic activity as it shows an anode potential of 1.60 volts after 500 hours as compared to a potential of 3.0 volts after 500 hours for the non-irradiated sample.

EXAMPLE 7

A titanium rod having a diameter of 3 mm was sandblasted with steel grit (100 to 200 mesh) and was then etched in boiling 20% HCl for 15 minutes. A thin layer of $RuO_2.TiO_2$ was applied on the etched titanium rod by chemideposition using a solution comprising $RuCl_3.3H_2O$, $TiCl_3$, hydrogen peroxide and isopropyl alcohol wherein the metal weight ratio Ru/Ti is 1. The solution was applied to the rod by brushing, and the base was dried and then treated at 450° to 480° C for 10 minutes in an oven under forced air circulation. The final coating amounted to 1 $g/m^2$ of Ru.

The precoated rod was then provided with a coating of $\beta$-$MnO_2$ using a solution of $Mn(NO_3)_2$ and isopropyl alcohol. The solution was applied by brush in several coats and an average of 1 $g/m^2$ of Mn was applied by each coat. After each coat was applied, the base was dried and then treated at 300° to 320° C in an oven under air atmosphere for 10 minutes. The operation was repeated 35 times and a coating containing about 40 $g/m^2$ of Mn was obtained. The coated titanium rod was used successfully as an anode for electrowinning cobalt from sulfate solutions at a current density of 600 $A/m^2$ and at 40° C bath temperature. After 2000 hours of operation, the anode potential had increase from the initial potential of 1.70 V(NHE) to 1.72 V(NHE) while the weight loss was negligeable.

Various modifications of the electrodes and the processes of the invention may be made without departing from the scope thereof and it should be understood that the invention is intended to be limited only as defined in the appended claims.

What is claimed is:

1. An electrode consisting essentially of a valve metal base or a base of other electrically-conductive material which is corrosion-resistant to the anodic conditions, having on at least a portion of its outer surface an electrocatalytic coating of β-manganese dioxide chemideposited by thermal decomposition of an alcoholic solution of manganese nitrate, the said β-manganese dioxide coating contains 0.5 to 5% by weight of at least one metal selected from the group consisting of metals of groups IB, IIB, IVA, VA, VB, VIB, VIIB and VIII of the Periodic Table excluding the platinum metals, gold and silver.

2. An electrode consisting essentially of a valve metal base or other electrically conductive material which is corrosion-resistant to the anodic conditions having on at least a portion of its outer surface an electrocatalytic coating of β-manganese dioxide chemi-deposited by thermal decomposition of an alcoholic solution of manganese nitrate wherein the β-manganese dioxide coating contains up to 20% by weight of a stabilizer selected from the group consisting of silicon dioxide, β-lead dioxide and tin dioxide.

3. An electrode consisting essentially of a valve metal base or other electrically conductive material which is corrosion-resistant to the anodic conditions having on at least a portion of its outer surface an electrocatalytic coating of β-manganese dioxide chemi-deposited by thermal decomposition of an alcoholic solution of manganese nitrate wherein the β-manganese dioxide coating is activated by irradiation with bata rays.

4. An electrode of claim 1 wherein the metal is cobalt.

5. An electrode of claim 1 wherein the metal is selected from the group consisting of bismuth, arsenic and antimony.

6. An electrode of claim 1 wherein the base is selected from a metal belonging to the group consisting of titanium, tantalum, zirconium, tungsten, niobium and alloys thereof.

7. An electrode of claim 6 wherein the electrically-conductive base is titanium containing up to 5% by weight of cobalt or manganese.

8. An electrode of claim 6 wherein the valve metal base is pre-coated with a layer of co-deposited valve metal oxide and an oxide of a metal belonging to the group composed of platinum, ruthenium, iridium, rhodium and palladium before being provided with the said outer layer of β-manganese dioxide.

9. An electrode of claim 8 wherein said valve metal base is titanium, said intermediate layer comprises $TiO_2.RuO_2$ in a metal ratio Ti:Ru that is between 1:0.5 and 1:1 and said intermediate layer amounts to 1 $g/m^2$ of Ru.

10. In an improved method of electrowinning metals from aqueous solutions thereof by passing an electrolysis current through an anode, an aqueous electrolyte containing the metal to be electrowon and a cathode, the improvement comprising using as the anode an electrode of claim 1.

11. The method of claim 10 wherein the β-manganese dioxide coating contains up to 5% by weight of at least one metal selected from the group consisting of metals of groups IB, IIB, IVA, VA, VB, VIB, VIIB and VIII of the Periodic Table excluding the platinum groups metals, gold and silver.

12. The method of claim 10 wherein the β-manganese dioxide coating is irradiated with beta rays.

* * * * *